US011039509B2

(12) United States Patent
Hofmann et al.

(10) Patent No.: US 11,039,509 B2
(45) Date of Patent: Jun. 15, 2021

(54) OVEN DOOR FOR A MICROWAVE OVEN

(71) Applicant: ELECTROLUX APPLIANCES AKTIEBOLAG, Stockholm (SE)

(72) Inventors: Arnd Hofmann, Rothenberg ob der Tauber (DE); Mario Weber, Rothenberg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 101 days.

(21) Appl. No.: 16/464,388

(22) PCT Filed: Nov. 24, 2017

(86) PCT No.: PCT/EP2017/080343
§ 371 (c)(1),
(2) Date: May 28, 2019

(87) PCT Pub. No.: WO2018/114218
PCT Pub. Date: Jun. 28, 2018

(65) Prior Publication Data

US 2020/0383180 A1 Dec. 3, 2020

(30) Foreign Application Priority Data

Dec. 20, 2016 (EP) ..... 16205547

(51) Int. Cl.
*H05B 6/64* (2006.01)
*F24C 15/04* (2006.01)
*H05B 6/76* (2006.01)

(52) U.S. Cl.
CPC ..... *H05B 6/6414* (2013.01); *H05B 6/763* (2013.01)

(58) Field of Classification Search
CPC ..... H05B 6/763; H05B 6/64; H05B 6/6414; H05B 6/76
USPC ..... 219/740, 741, 742, 743, 744, 738, 739; 126/39 R, 41 R, 190, 198, 200, 341; 24/630; 49/501, 21; 52/209, 786.1
See application file for complete search history.

(56) References Cited

U.S. PATENT DOCUMENTS 4,206,338 A * 6/1980 Katona ..... F24C 15/04 219/740
4,215,258 A * 7/1980 Nelson ..... H05B 6/766 126/200

FOREIGN PATENT DOCUMENTS

| | | |
|---|---|---|
| CN | 1580647 | 2/2005 |
| CN | 1940391 | 4/2007 |
| CN | 102808568 | 12/2012 |
| CN | 103712251 | 4/2014 |

(Continued)

OTHER PUBLICATIONS

International Search Report and Written Opinion in PCT/EP2017/080343 dated Mar. 9, 2018, 8 pages.

(Continued)

*Primary Examiner* — Quang T Van
(74) *Attorney, Agent, or Firm* — Pearne & Gordon LLP

(57) ABSTRACT

An oven door for a microwave oven or a cooking oven with microwave heating functions includes at least one door cover (12) and at least one glass panel (14). The door cover (12) and the inner glass panel (14) form an inner part of the oven door. The door cover (12) and the glass panel (14) are connected by a welded joint (16). Said welded joint (16) is formed in an overlap of the door cover (12) and the glass panel (14). The welded joint (16) forms an elongated path.

16 Claims, 3 Drawing Sheets

(56) References Cited

FOREIGN PATENT DOCUMENTS

| | | | | |
|---|---|---|---|---|
| CN | 203560965 | U | * | 4/2014 |
| EP | 0763964 | A2 | | 3/1997 |
| JP | S5457553 | U | | 4/1979 |
| JP | S62299632 | A | | 12/1987 |
| JP | 2013015254 | | | 1/2013 |

OTHER PUBLICATIONS 2,hinese Office action for counterpart application no. Cn 201780077844.8 dated Dec. 30, 2020, 10 pp. 'English Translation), 10 pp.

* cited by examiner

OVEN DOOR FOR A MICROWAVE OVEN

The present invention relates to an oven door for a microwave oven or a cooking oven with microwave heating functions. Further, the present invention relates to a microwave oven or a cooking oven with microwave heating functions.

A microwave oven generates electromagnetic fields for heating food and beverages in the oven cavity. Usually, the oven door of the microwave oven comprises at least an inner glass panel and an outer glass panel. The oven door of the microwave oven is partially transparent, so that the user is able to monitor the progress of the cooking process in the oven cavity. Compared to an oven door of a cooking oven without microwave heating functions, the transparent area of the oven door for the microwave oven is relative small, since a wave choke device is arranged within the door frame. Said wave choke device blocks the gap between the oven door and a front frame of the microwave oven against the electromagnetic field inside the oven cavity. The wave choke device is covered by a door cover made of non-metallic parts. Preferably, said door cover is made of high temperature resistant polymers.

Usually, the inner glass panel and the door frame are connected by a glue joint consisting of silicone. The temperature resistance of silicone is lower than 200° C., while the temperature resistance of the door frame and glass panel is higher. Further, the glue joint is positioned in an area of critical temperatures, due to the extension of the wave choke device. Thus, the glue joint is thermally stressed, so that failures in the oven door may occur. For example, condensate may infiltrate into the interior of the oven door. Further, the inner glass panel may be lost.

Figure 6:
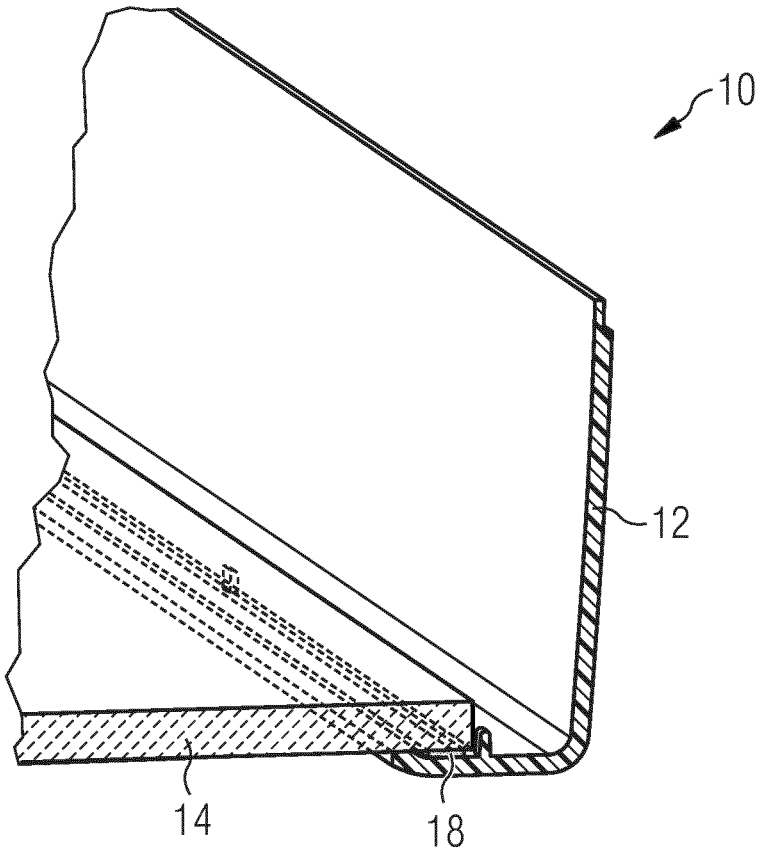

FIG. 6 illustrates a schematic sectional perspective view of the inner part 10 of the oven door for the microwave oven according to the prior art. The inner part 10 of the oven door includes a door cover 12 and an inner glass panel 14. The door cover 12 encloses the inner glass panel 14. The inner glass panel 14 faces the oven cavity of the microwave oven in the closed state of the oven door, wherein a gasket is arranged between the inner glass panel 14 and the oven cavity. The welded system consisting of glass panel 14 and door cover 12 includes an L-shaped cross-section, wherein an inner leg of said L-shaped cross-section extends parallel to the plane of the inner glass panel 14. An outer leg of the L-shaped cross-section encloses the inner leg, is arranged perpendicular to said inner leg and extends outwards from the inner leg. The inner leg of the door cover 12 and an outer portion of an inner surface of the inner glass panel 14 overlap. In an overlap area of the inner leg of the door cover 12 and the inner glass panel 14, said door cover 12 and inner glass panel 14 are glued together. A glue joint 18 is formed in the overlap area of the inner leg of the door cover 12 and the inner glass panel 14. The outer portion of the inner surface of the inner glass panel 14 is connected to an outer side of the inner leg of the door cover 12 by the glue joint 18.

It is an object of the present invention to provide an oven door for a microwave oven, wherein the connection between the door cover and at least one glass panel is improved.

According to the present invention an oven door for a microwave oven or a cooking oven with microwave heating functions is provided, wherein:

- the oven door comprises at least one door cover and at least one glass panel,
- the door cover and the inner glass panel form an inner part of the oven door,

- the door cover encloses the glass panel,
- the door cover and the glass panel are connected by a welded joint,
- the welded joint is formed in an overlap area of the door cover and the glass panel, and
- the welded joint (16) forms an elongated path.

The core of the present invention is the welded joint between the door cover and the glass panel. The welded joint provides a high temperature resistance and a tight connection between the door cover and the inner glass panel. Further, the welded joint provides an improved design of the inner side of the oven door.

In particular, the welded joint forms a closed elongated path or at least one open elongated path, wherein preferably the door cover encloses completely the glass panel. The door cover enclosing completely the glass panel contributes to the tight connection between the door cover and the inner glass panel.

Further, the glass panel may be an inner glass panel and faces an oven cavity in a closed state of the oven door, wherein preferably a gasket is provided between said inner glass panel and oven cavity. The inner glass panel is in a high temperature area.

Moreover, the door cover may include at least one dielectric material, wherein preferably at least a part of the door cover is made of polymers, or the door cover is made of metal.

According to one embodiment of the present invention, the overlap area is formed by an outer portion of a surface of the glass panel and a surface at an inner portion of the door cover, wherein the surface at the inner portion of the door cover extends parallel to the plane of the glass panel, and wherein preferably the inner portion of the door cover faces the oven cavity in the closed state of the oven door, while the welded joint at the inner portion of the door cover faces away from the oven cavity in the closed state of the oven door.

Further, the door cover may include an L-shaped cross-section, wherein a first leg of the L-shaped cross-section may form the inner portion of the cross-section of the door cover, while a second leg of the L-shaped cross-section may enclose the first leg and may extend away from the oven cavity in the closed state of the oven door.

According to another example, the first leg of the L-shaped cross-section of the door cover is made of the dielectric material, while the second leg of the L-shaped cross-section of said door cover is made of metal. Preferably, the first leg of the L-shaped cross-section of the door cover is made of polymers.

In particular, the corner of the L-shaped cross-section of the door cover is made of the dielectric material, preferably of polymers.

According to another embodiment of the present invention, the overlap area is formed by an inner side of the door cover and a circumferential side of the inner glass panel, so that the circumferential side of the inner glass panel is connected to the inner side of the door cover by the welded joint.

Additionally, the oven door may comprise an outer glass panel attached or attachable to an outer side of the door cover, wherein said outer side of the door cover faces away from the oven cavity.

Preferably, the outer glass panel is glued to door columns, wherein preferably the door cover is fixed to said door columns.

Alternatively, the oven door may comprise a further door cover glued to the outer glass panel, wherein preferably the door cover is fixed to said further door cover.

Moreover, the oven door may comprise at least one intermediate glass panel arranged between the inner glass panel and the outer glass panel.

Additionally, the oven door comprises a wave choke device 24 (FIG. 4) enclosing at least one glass panel and covered by the door cover and/or the further door cover. The wave choke device is provided for blocking a gap formed between the oven door and the microwave oven against the electromagnetic field inside the oven cavity.

At last, the present invention relates to a microwave oven or a cooking oven with microwave heating functions, wherein the microwave oven or cooking oven with microwave heating functions, respectively, comprises at least one oven door mentioned above.

Novel and inventive features of the present invention are set forth in the appended claims.

Figure 1:
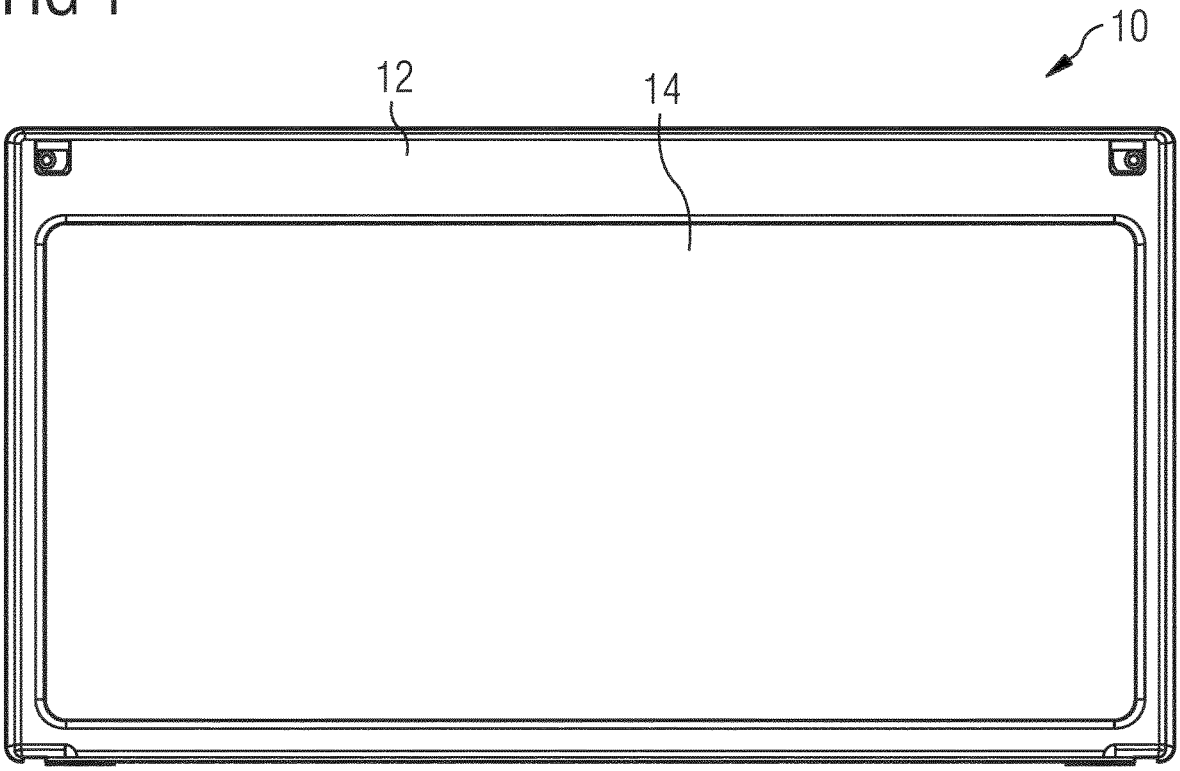
Figure 2:
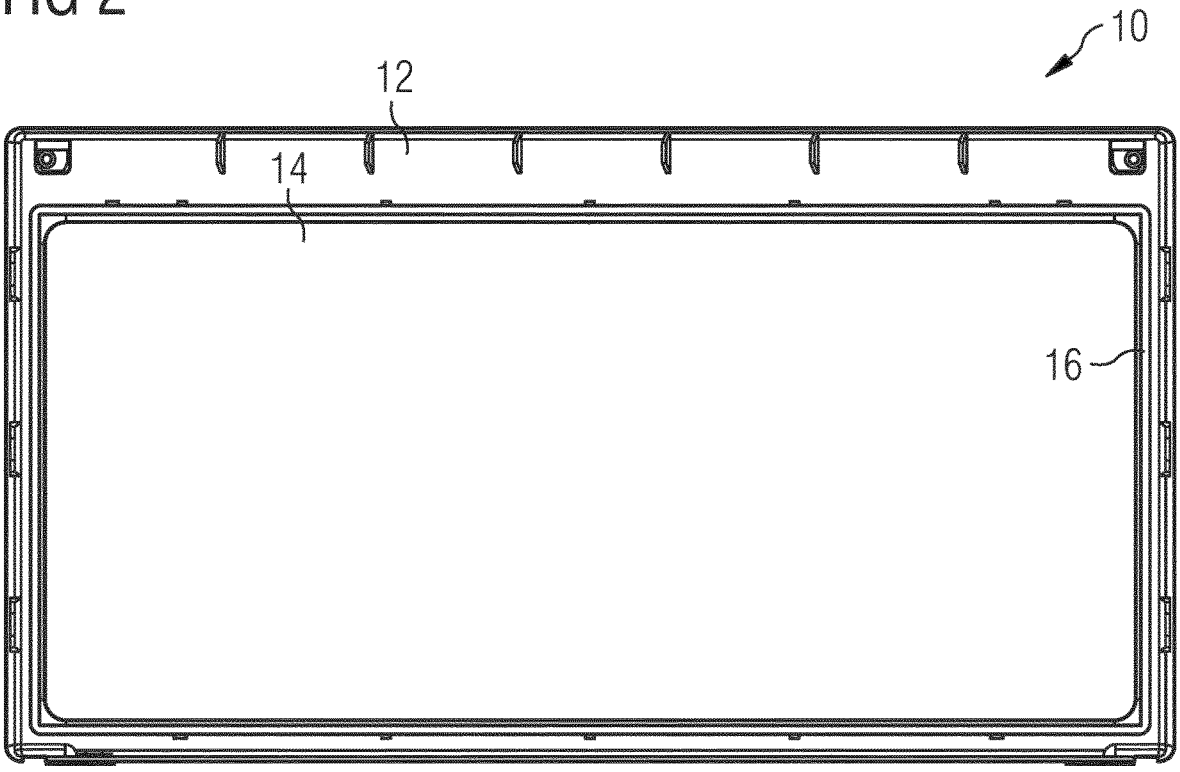
Figure 3:
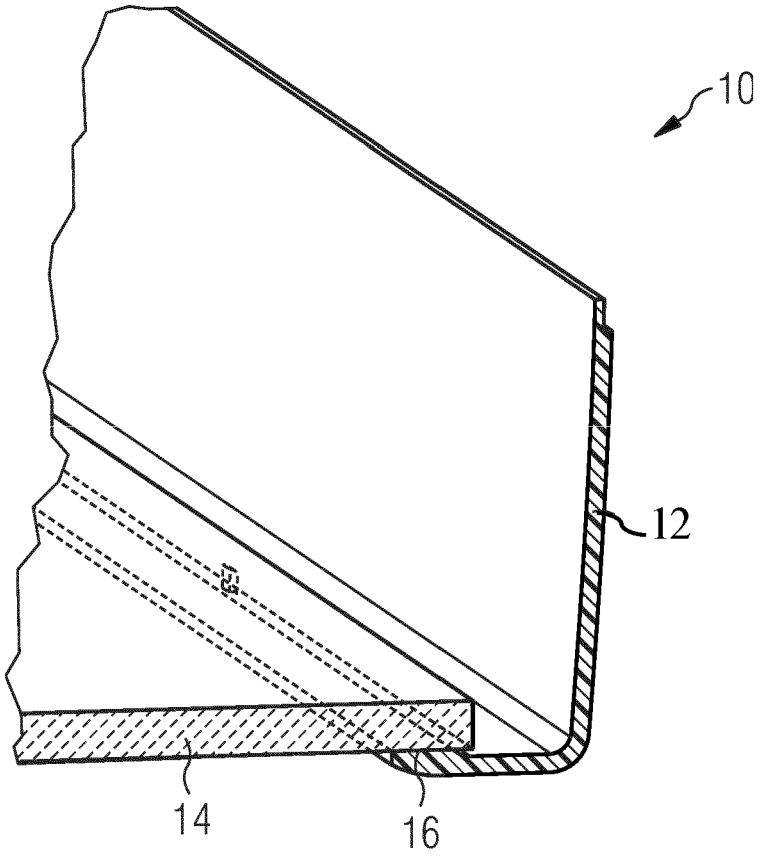
Figure 4:
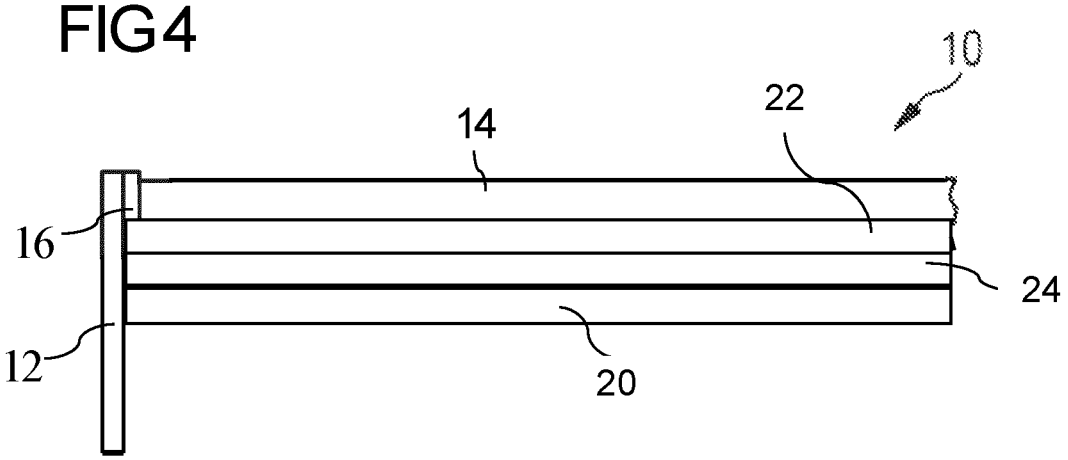
Figure 5:
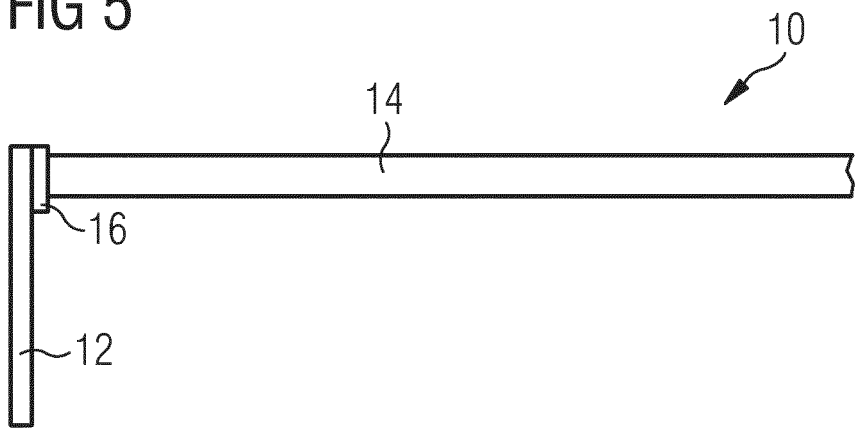

The present invention will be described in further detail with reference to the drawings, in which FIG. 1 illustrates a schematic view at an outer side of an inner part of an oven door for a microwave oven according to a first embodiment of the present invention, FIG. 2 illustrates a schematic view at an inner side of the inner part of the oven door for the microwave oven according to the first embodiment of the present invention, FIG. 3 illustrates a schematic sectional perspective view of the inner part of the oven door for the microwave oven according to the first embodiment of the present invention, FIG. 4 illustrates a schematic sectional view of the inner part of the oven door for the microwave oven according to a second embodiment of the present invention, FIG. 5 illustrates a schematic sectional view of the inner part of the oven door for the microwave oven according to a third embodiment of the present invention, and FIG. 6 illustrates a schematic sectional perspective view of the inner part of the oven door for the microwave oven according to the prior art.

FIG. 1 illustrates a schematic view at an outer side of an inner part 10 of the oven door for a microwave oven according to a first embodiment of the present invention. The outer side of the inner part 10 of the oven door faces away from an oven cavity in a closed state of said door. The inner part 10 of the oven door is that part facing an oven cavity of the microwave oven in a closed state of the oven door. The term "inner" relates to the direction to the oven cavity of the microwave oven in a closed state of the oven door. In contrast, the term "outer" relates to the direction away from the oven cavity of the microwave oven and to the front of said microwave oven in the closed state of the oven door.

The inner part 10 of the oven door includes a door cover 12 and an inner glass panel 14. The door cover 12 encloses the inner glass panel 14. The inner glass panel 14 faces the oven cavity of the microwave oven in the closed state of the oven door, wherein a gasket is provided between the inner glass panel 14 and the oven cavity. The gasket touches the inner glass panel 14 in the closed state of the oven door. The gasket is made of silicone or mesh. Mesh is suitable for pyrolytic ovens. In this example, the door cover 12 has an L-shaped cross-section. An inner leg of said L-shaped cross-section extends parallel to the plane of the inner glass panel 14. An outer leg of the L-shaped cross-section encloses the inner leg, is arranged perpendicular to said inner leg and extends outwards from the inner leg.

The inner leg of the door cover 12 and an outer portion of an inner surface of the inner glass panel 14 overlap. In an overlap area of the inner leg of the door cover 12 and the inner glass panel 14, said door cover 12 and inner glass panel 14 are welded together. Preferably, the door cover 12 is made of plastics. In particular, the door cover 12 is made of polymers.

FIG. 2 illustrates a schematic front view of the inner part 10 of the oven door for the microwave oven according to the first embodiment of the present invention. The inner side of the inner part 10 of the oven door faces the oven cavity in the closed state of said door. FIG. 2 clarifies the connection between the door cover 12 and the inner glass panel 14.

A welded joint 16 is formed in the overlap area between the inner leg of the door cover 12 and the inner glass panel 14. The door cover 12 and the inner glass panel 14 are welded together. The welded joint 16 provides a high temperature resistance. Further, the welded joint 16 provides a tight connection between the door cover 12 and the inner glass panel 14. Moreover, the welded joint 16 provides an improved design of the inner part 10 of the oven door.

FIG. 3 illustrates a schematic sectional perspective view of the inner part 10 of the oven door for the microwave oven according to the first embodiment of the present invention. The inner leg of the door cover 12 and the outer portion of the inner surface of the inner glass panel 14 overlap. FIG. 3 clarifies the arrangement of the welded joint 16 between the door cover 12 and the inner glass panel 14.

The welded joint 16 is formed in the overlap area of the inner leg of the door cover 12 and the inner glass panel 14. The outer portion of the inner surface of the inner glass panel 14 is connected to an outer side of the inner leg of the door cover 12 by the welded joint 16. The welded joint 16 allows the high temperature resistance and the tight connection between the door cover 12 and the inner glass panel 14. Moreover, the welded joint 16 provides an improved design of the inner part 10 of the oven door.

The door cover 12 has the L-shaped cross-section. The inner leg of said L-shaped cross-section extends parallel to the plane of the inner glass panel 14, while the outer leg of the L-shaped cross-section encloses the inner leg. The outer leg is arranged perpendicular to the inner leg and extends outwards from the inner leg. For example, the door cover 12 is made of dielectric material, preferably of polymers. Alternatively, the inner leg of the door cover 12 is made of dielectric material, while the outer leg of the door cover 12 may be made of metal, wherein the corner of the L-shaped cross-section of the door cover 12 is made of dielectric material.

An outer glass panel 20 (FIG. 4) of the oven door is attached or attachable to the door cover 12 by different ways. For example, the outer glass panel is welded to a further door cover, wherein said further door cover is permanently or removably connected to the door cover 12. In this case, the door cover 12 may form an inner door cover, while the further door cover may form an outer door cover. Further, the outer glass panel may be directly connected to the door cover 12 by a further welded joint or by any other connection. Moreover, the outer glass panel may include door columns welded or glued onto the inner surface of the outer glass panel, wherein said door columns are permanently or removably connected to the door cover 12.

An intermediate layer 22 FIG. 4 may be arranged between the inner glass panel 14 and the outer glass panel 20. For example, the intermediate layer is formed by metallization of the outer surface of the inner glass panel 14. Further, the intermediate layer may be a separate panel and welded to the door cover 12.

Further, at least one metal side frame may be welded to the door cover 12, wherein said metal side frame supports the outer glass panel, the intermediate layer and/or further glass panels.

FIG. 4 illustrates a schematic sectional view of the inner part 10 of the oven door for the microwave oven according to a second embodiment of the present invention.

The inner part 10 of the oven door includes the door cover 12 and the inner glass panel 14. The door cover 12 encloses the inner glass panel 14. The inner glass panel 14 faces the oven cavity of the microwave oven in the closed state of the oven door.

Preferably, the gasket is provided between the inner glass panel 14 and the oven cavity. The gasket touches the inner glass panel 14 in the closed state of the oven door. The gasket is made of silicone or mesh. Mesh is suitable for pyrolytic ovens.

In this embodiment, the door cover 12 has an I-shaped cross-section. The I-shaped cross-section of the door cover 12 extends perpendicular to the plane of the inner glass panel 14.

The welded joint 16 is formed in the overlap area of the inner side of the door cover 12 and the circumferential side of the inner glass panel 14. The circumferential side of the inner glass panel 14 is connected to the inner side of the door cover 12 by the welded joint 16. The welded joint 16 allows the high temperature resistance and the tight connection between the door cover 12 and the inner glass panel 14. Moreover, the welded joint 16 provides an improved design of the inner part 10 of the oven door.

For the purpose of clarity, the welded joint 16 represented in FIG. 4 is bigger than the real welded joint 16. In practice, the welded joint 16 is smaller than the representation in FIG. 4.

In this embodiment, the door cover 12 is made of a dielectric material. For example, the door cover 12 is made of plastics. In particular, the door cover 12 is made of polymers.

FIG. 5 illustrates a schematic sectional view of the inner part 10 of the oven door for the microwave oven according to a third embodiment of the present invention. The third embodiment has similar geometric properties as the second embodiment of the present invention.

The inner part 10 of the oven door includes the door cover 12 and the inner glass panel 14, wherein the door cover 12 encloses the inner glass panel 14. The inner glass panel 14 faces the oven cavity of the microwave oven in the closed state of the oven door.

Preferably, the gasket is provided between the inner glass panel 14 and the oven cavity, wherein the gasket touches the inner glass panel 14 in the closed state of the oven door. The gasket may be made of silicone or mesh. Mesh is suitable for pyrolytic ovens.

Also in this embodiment, the door cover 12 has the I-shaped cross-section, wherein said I-shaped cross-section of the door cover 12 extends perpendicular to the plane of the inner glass panel 14.

The welded joint 16 is formed in the overlap area of the inner side of the door cover 12 and the circumferential side of the inner glass panel 14. The circumferential side of the inner glass panel 14 is connected to the inner side of the door cover 12 by the welded joint 16. The welded joint 16 allows the high temperature resistance and the tight connection between the door cover 12 and the inner glass panel 14. Moreover, the welded joint 16 provides an improved design of the inner part 10 of the oven door.

For the purpose of clarity, the welded joint 16 represented in FIG. 5 is bigger than the real welded joint 16. In practice, the welded joint 16 is smaller than the representation in FIG. 5.

In the third embodiment, the door cover 12 is made of metal. For example, the door cover 12 is made of aluminium or stainless steel.

In general, the door cover 12 according to the present invention may have an arbitrary shape, which is suitable for providing the overlap area with the glass panel 14.

FIG. 6 illustrates a schematic sectional perspective view of the inner part 10 of the oven door for the microwave oven according to the prior art.

The inner part 10 of the oven door includes the door cover 12 and the inner glass panel 14. The door cover 12 encloses the inner glass panel 14. The inner glass panel 14 faces directly the oven cavity of the microwave oven in the closed state of the oven door. The door cover 12 has the L-shaped cross-section. The inner leg of said L-shaped cross-section extends parallel to the plane of the inner glass panel 14, while the outer leg of the L-shaped cross-section encloses the inner leg, is arranged perpendicular to said inner leg and extends outwards from the inner leg.

The inner leg of the door cover 12 and the outer portion of the inner surface of the inner glass panel 14 overlap. In the overlap area of the inner leg of the door cover 12 and the inner glass panel 14, said door cover 12 and inner glass panel 14 are glued together. A glue joint 18 is formed in the overlap area of the inner leg of the door cover 12 and the inner glass panel 14. The outer portion of the inner surface of the inner glass panel 14 is connected to an outer side of the inner leg of the door cover 12 by the glue joint 18. The inner part 10 of the oven door according to the prior art includes the glue joint 18 instead of the welded joint 16 according to the present invention.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 inner part of the oven door
12 door cover
14 inner glass panel
16 welded joint
18 glue joint

The invention claimed is:

1. An oven door for closing an oven cavity of a microwave oven or a cooking oven with microwave heating functions, wherein:

the oven door comprises at least one door cover and an inner glass panel, the door cover and the inner glass panel form an inner part of the oven door, the door cover encloses the inner glass panel, the door cover and the inner glass panel are connected by a welded joint, the welded joint is formed in an overlap area of the door cover and the inner glass panel, and the welded joint forms an elongated path, wherein the door cover has an L-shaped cross-section, wherein a first leg of the L-shaped cross-section forms an inner portion of the door cover, while a second leg of the L-shaped cross-section encloses the first leg and extends away from the oven cavity in a closed state of the oven door.

2. The oven door according to claim 1, wherein the welded joint forms a at least one open elongated path, wherein the door cover encloses completely the glass panel.

3. The oven door according to claim 1, wherein the inner glass panel faces the oven cavity in a closed state of the oven door, wherein preferably a gasket is provided between the inner glass panel and the oven cavity.

4. The oven door according to claim 1, wherein the door cover includes at least one dielectric material, wherein preferably at least a part of the door cover is made of polymers, or the door cover is made of metal.

5. The oven door according to claim 1, wherein the overlap area is formed by an outer portion of a surface of the inner glass panel and a surface at an inner portion of the door cover, wherein the surface at the inner portion of the door cover extends parallel to a plane of the inner glass panel, and wherein preferably the inner portion of the door cover faces the oven cavity in the closed state of the oven door, while the welded joint at the inner portion of the door cover faces away from the oven cavity in the closed state of the oven door.

6. The oven door according to claim 1, wherein the first leg of the L-shaped cross-section of the door cover is made of the at least one dielectric material, while the second leg of the L-shaped cross-section of said door cover is made of metal, wherein preferably the first leg of the L-shaped cross-section of the door cover is made of polymers.

7. The oven door according to claim 6, wherein a corner of the L-shaped cross-section of the door cover is made of the at least one dielectric material, preferably of polymers.

8. The oven door according to claim 1, wherein the overlap area is formed by an inner side of the door cover and a circumferential side of the inner glass panel, so that the circumferential side of the inner glass panel is connected to the inner side of the door cover by the welded joint.

9. The oven door according to claim 1, wherein the oven door comprises an outer glass panel attached or attachable to an outer side of the door cover, wherein said outer side of the door cover faces away from the oven cavity.

10. The oven door according to claim 9, wherein the outer glass panel is glued to the door columns, wherein preferably the door cover is fixed to said door columns.

11. The oven door according to claim 9, wherein the oven door comprises a further door cover glued to the outer glass panel, wherein the door cover is fixed to said further door cover.

12. The oven door according to claim 9, wherein the oven door comprises at least one intermediate glass panel arranged between the inner glass panel and the outer glass panel.

13. The oven door according to claim 1, wherein the oven door comprises a wave choke device enclosing the inner glass panel and covered by the door cover and the further door cover.

14. A microwave oven or a cooking oven with microwave heating functions, comprising the oven door according to claim 1.

15. The oven door according to claim 1, wherein the oven door comprises a wave choke device enclosing the inner glass panel and covered by the door cover or the further door cover.

16. The oven door according to claim 1, wherein the welded joint forms a closed elongated path, wherein the door cover encloses completely the glass panel.

* * * * *